United States Patent [19]

Leist

[11] Patent Number: 4,911,507

[45] Date of Patent: Mar. 27, 1990

[54] MOBILE STORAGE SYSTEM WITH ANTI-TIP CONSTRUCTION

[75] Inventor: Alan R. Leist, Grand Rapids, Mich.

[73] Assignee: Pipp Mobile Systems, Inc., Grand Rapids, Mich.

[21] Appl. No.: 364,120

[22] Filed: Jun. 12, 1989

[51] Int. Cl.[4] ..... A47B 53/00

[52] U.S. Cl. ..... 312/201; 312/250

[58] Field of Search ..... 312/198, 199, 201, 256, 312/343, 348, 349, 350, 342, 346

[56] References Cited

U.S. PATENT DOCUMENTS

| | | | |
|---|---|---|---|
| 2,000,463 | 5/1935 | Browne | 312/346 |
| 4,597,615 | 7/1986 | Steger | 312/201 |
| 4,789,210 | 12/1988 | Weiss et al. | 312/346 X |

*Primary Examiner*—Joseph Falk

*Attorney, Agent, or Firm*—Warner, Norcross & Judd

[57] ABSTRACT

A mobile storage system universal anti-tipping system includes at least one auxiliary track and at least one anti-tip structure attached to the mobile shelving carriage and retained by the track. The auxiliary track defines a gap which cooperates with an extended portion of the anti-tip structure to prevent the carriage and supported mobile storage unit from tipping over.

23 Claims, 2 Drawing Sheets

MOBILE STORAGE SYSTEM WITH ANTI-TIP CONSTRUCTION

BACKGROUND OF THE INVENTION

The present invention pertains to a mobile storage system including an anti-tip system for preventing tipping of the individual storage units. Generally, mobile storage systems fill the floor with movable side-by-side shelving units so that only a single aisle is provided in the entire storage area. An example of such a system is illustrated in U.S. Pat. No. 4,597,615 to Steger, and entitled STORAGE SYSTEM. Access to a particular unit is enabled by moving certain of the mobile shelving units to create an aisle adjacent the unit.

However, without the provision of an anti-tip arrangement, these mobile systems are subject to certain governmental safety restrictions. More specifically, OSHA regulations prohibit mobile storage units without an anti-tipping arrangement from exceeding a height-to-width ratio of 4 to 1. Accordingly, a typical two foot wide storage unit is limited to a height of eight feet. Furthermore, the California Seismic Safety Authority has ruled that all mobile storage systems installed in California must include anti-tip systems due to the additional hazards caused by earthquakes.

A common type of anti-tip system involves the use of upper bracing systems which fixedly mount to the ceiling, an adjacent wall, or on columns extending up from the floor. These bracing systems are coupled with the upper portions of the storage units to prohibit their tipping. One example of such a system is disclosed in copending application 07/129,683 filed Dec. 7, 1987, and entitled MOBILE SHELVING ANTI-TIP MECHANISM. This type of arrangement, however, is complex, expensive to fabricate and install, and produces an unsightly appearance. Moreover, if used in California, one must additionally verify that the ceiling, wall, or columns are sufficiently strong to resist the extra loads in the event of an earthquake.

Another type of anti-tip system is that manufactured and sold by Kardex, Inc., which includes specially designed carriages and carriage tracks. More particularly, the carriage tracks have raised outer edges which define narrow grooves with the floor. The carriages have cooperating L-shaped flanges which are received within the defined groove to prevent the shelving units from tipping over. Although, this arrangement eliminates many of the above mentioned shortcomings, such a system still includes several problems. More particularly, large stresses are generated within the track to offset the great moment forces invariably produced by the tipping. Accordingly, the carriage tracks must be extremely strong and rigid to sufficiently offset the risk of structural failure. Additionally, these anti-tip systems cannot be readily retrofitted to existing mobile shelving systems.

SUMMARY OF THE INVENTION

In accordance with the present invention, a unique anti-tip system includes a floor-mounted auxiliary track and a cooperating structure attached to the movable carriage and retained by the auxiliary track. The present system can be retrofitted on nearly any mobile storage system. By employing an auxiliary track, additional stress loads on the carriage tracks are avoided. Since the system is floor mounted, the additional expenses and difficulties frequently involved in California installations are eliminated.

These and other objects, advantages, and features of the present invention will be more fully understood and appreciated by reference to the written specification and appended drawings.

DETAILED DESCRIPTION OF THE PREFERRED EMBODIMENTS

Figure 1:
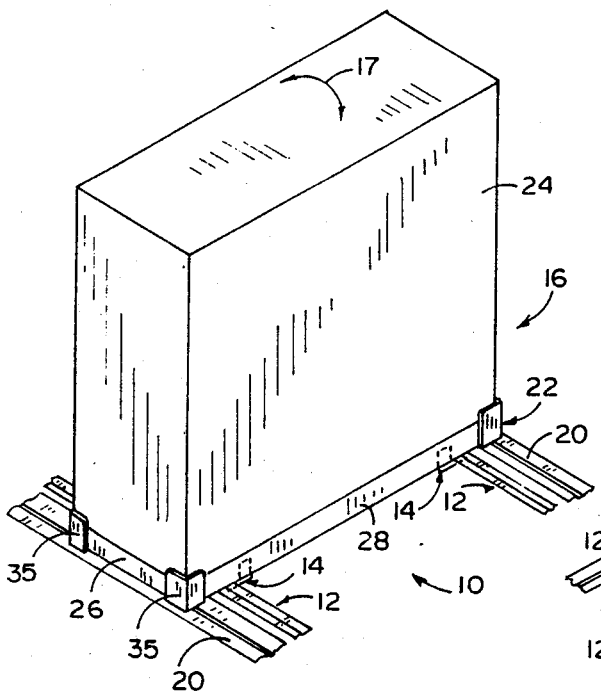
FIG. 1 is a perspective view of a first mobile storage system supporting a mobile storage unit and including an anti-tip system of the present invention.
Figure 2:
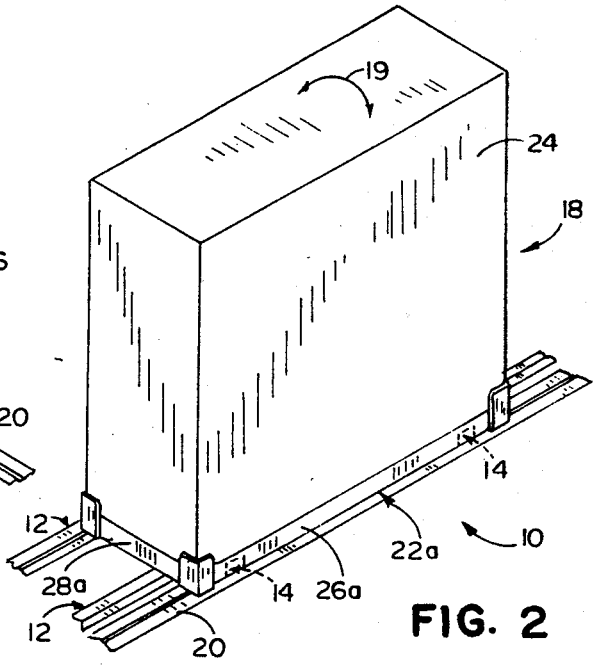
FIG. 2 is a second mobile storage system supporting a mobile storage unit and including the anti-tip system.
Figure 5:
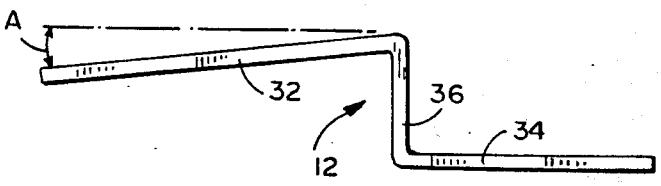
FIG. 5 is an end elevational view of an anti-tip track of the anti-tip system.

Anti-tip system 10 basically includes an auxiliary or retainer track 12 and a cooperating retainer or anti-tipping flange 14. Anti-tip system 10 can be used in conjunction with virtually any mobile storage system. For illustrative purposes, system 10 is shown in use on two different mobile storage systems 16, 18 (FIGS. 1 and 2). In general, storage units of storage systems 16 will tend to tip in directions indicated by arrows 17, and those of storage systems 18 will tend to tip in directions indicated by arrows 19.

A typical mobile storage system 16 (FIG. 1), includes a pair of carriage tracks 20 and a carriage 22 rollingly supported thereon. Carriage 22, in turn, functions to movably support a mobile storage unit 24 such as shelves for movement along tracks 20. Carriage 22 is generally a rectangular framework comprised of a pair of relatively short longitudinal members 26 overlying the carriage tracks 20, and a pair of interconnecting, relatively long transverse members 28. Longitudinal members 26 are each provided with a plurality of downwardly projecting rollers 30 rollingly engaging carriage tracks 20. Members 26, 28 further include upper supporting surfaces 31, 33 upon which the mobile storage unit 24 is placed. These units 24 are then typically secured by bolting or the like to a member of the carriage 22, such as upstanding corner supports 35. Although only one carriage is illustrated, any number of carriages could be supported on the carriage tracks. Likewise, additional carriage tracks could also be used if the storage units were long.

Auxiliary track 12 is essentially an elongated Z-shaped plate member having a retaining or anti-tipping segment 32, base segment 34, and an upstanding medial segment 36 (FIGS. 4–7). In use, base segment 34 lies flush against the floor 38 and is secured thereto with bolts 44 or the like. To facilitate this mounting, base segment 34 is provided with a series of holes 42 through which bolts 44 may be passed. Of course, other securing arrangements could be used. Medial segment 36 and retaining segment 32 then define with floor 38 a narrow, elongated gap 40. In addition, retaining segment 32 is preferably at a slight inclination to the horizontal, at an angle A of approximately three degrees. This arrangement enables the track to better resist the tipping forces (as discussed below) and prevent the flange from becoming inclined upwardly after repeated use.

Figure 3:
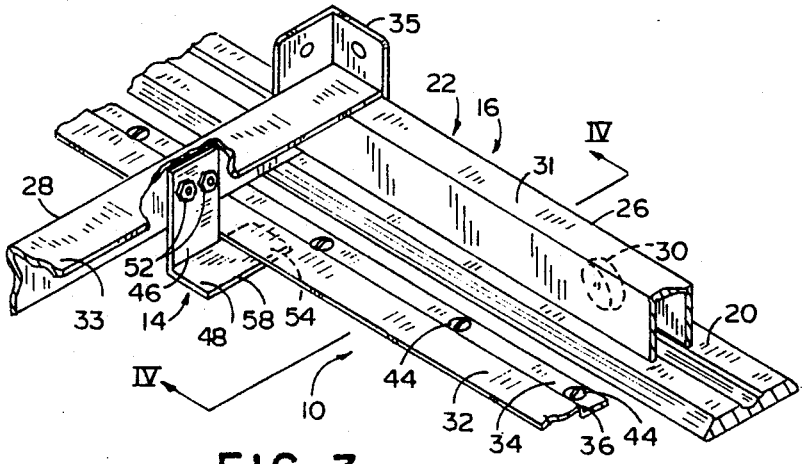
FIG. 3 is a fragmentary perspective view of the anti-tip system in use with the first mobile storage system.
Figure 4:
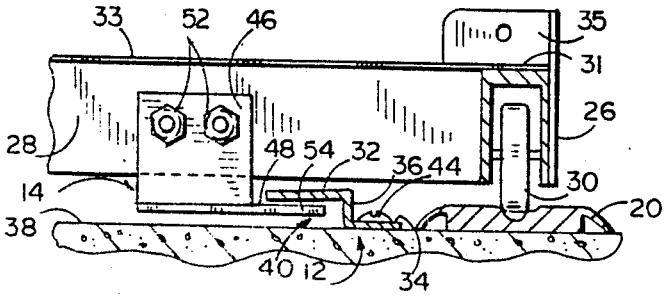
FIG. 4 is a cross-sectional view taken along lines IV—IV in FIG. 3.
Figure 6:
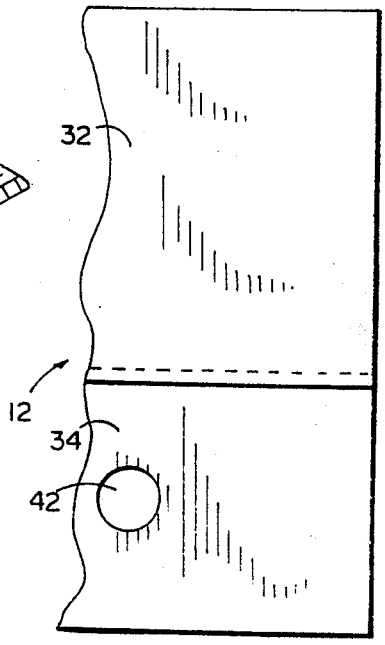
FIG. 6 is a fragmentary top plan view of the anti-tip track.
Figure 7:
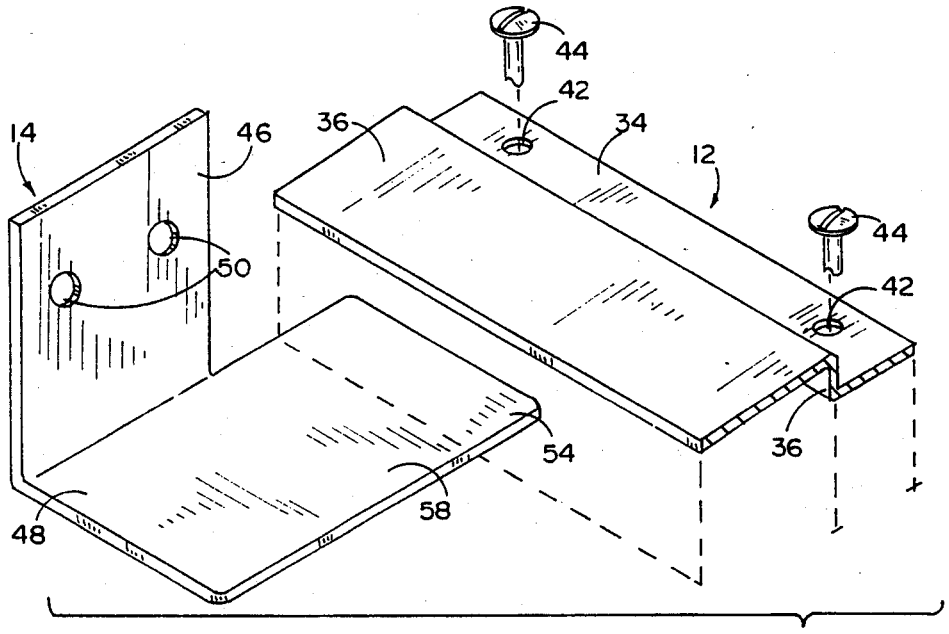
FIG. 7 is an exploded perspective view of the two main components of the anti-tip system in use with the first mobile storage system.
Figure 8:
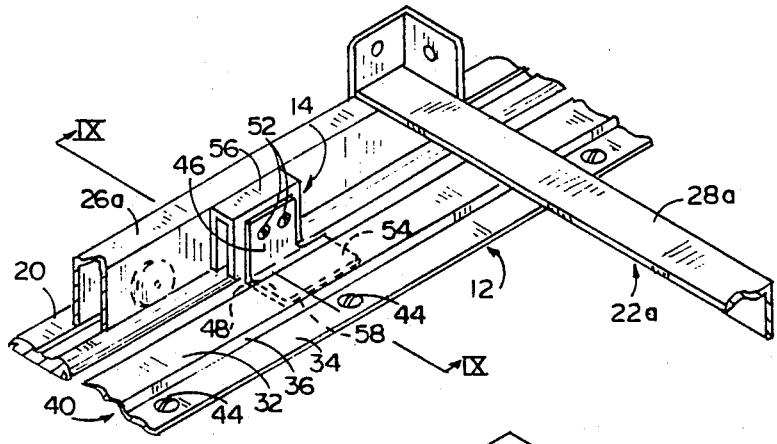
FIG. 8 is a fragmentary perspective view of the anti-tip system in use with the second mobile storage system.
Figure 9:
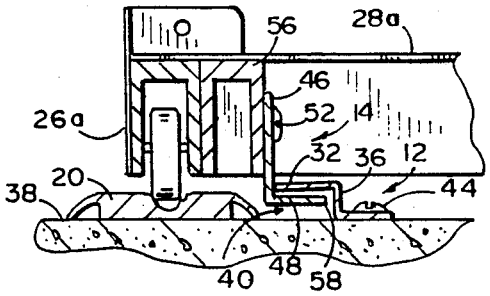
FIG. 9 is a cross-sectional view taken along line IX—IX in FIG. 8.
Figure 10:
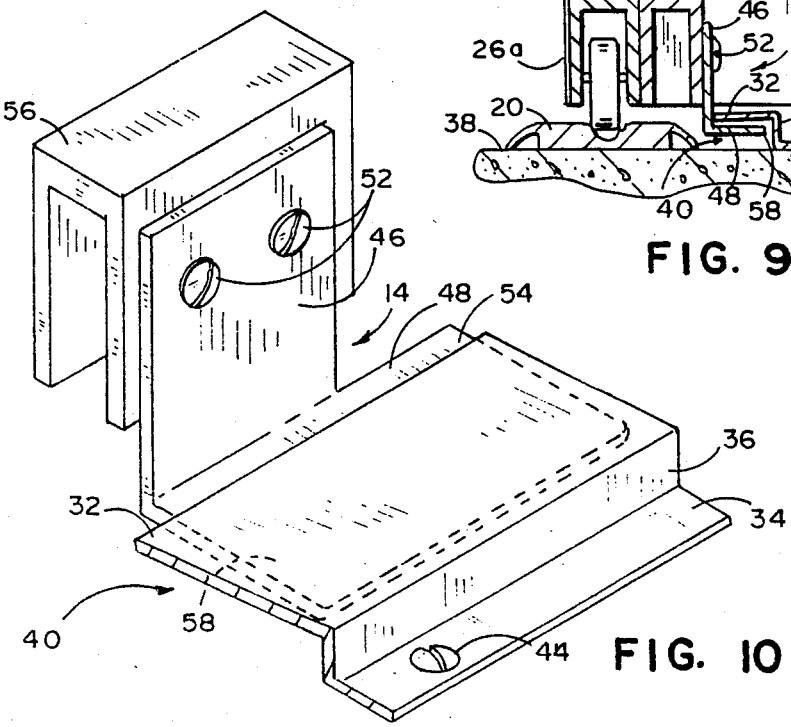
FIG. 10 is a fragmentary perspective view of the main components of the anti-tip system in use with the second mobile storage system.

Cooperating with auxiliary track 12 is an L-shaped retainer flange 14 including a vertical mounting portion 46 and a horizontal finger portion 48 extending orthogonally therefrom (FIGS. 3, 4, and 7). In the preferred embodiment, mounting portion 46 includes a pair of holes 50 to receive therethrough bolts 52 for mounting flange 14 to one of the transverse members 28. Of course other mounting arrangements could be used. Finger 48 extends outwardly and laterally from mounting portion 46, such that a free end 54 is defined. Free end 54 is positioned for receipt within gap 40. In normal operation, free end 54 is spaced between retaining segment 32 of auxiliary track 12 and floor 38 so that it makes no engagement therewith to inhibit the rolling of the carriage 22. However, should storage unit 24 begin to tip, free end 54 would quickly engage either of segment 32 of auxiliary track 12 or floor 38, depending on the particular spacing provided between the elements. Moreover, the inclination of segment 32 of auxiliary track 12 will also tend to prevent slippage of flange 14 from gap 40 due to a twisting motion of the storage unit 24.

Auxiliary track 12 is positioned between carriage tracks 20 so that it underlies carriage 22 (FIGS. 1 and 3). In the preferred arrangement, auxiliary track 12 is mounted adjacent one of the carriage tracks 20 such that gap 40 opens outwardly therefrom and toward the opposing carriage track 20. Nevertheless, auxiliary track 12 could be placed anywhere beneath carriage 22 and face in either direction. When used with smaller mobile storage units, one auxiliary track 12 and cooperating retainer flange 14 will generally be sufficient to eliminate the tipping hazard. However, with longer mobile storage units a pair of auxiliary tracks 12 should be used with one positioned adjacent each of the outside carriage tracks to prevent the unit from twisting and falling (FIG. 1).

Additionally, anti-tipping system 10 may also be used in conjunction with the second mobile storage systems 18 (FIGS. 2 and 8–10). In these arrangements, retainer flange 14 is preferably mounted to the longitudinal members **26*a* of carriage 22*a*. In this embodiment, longitudinal members 26*a* are relatively long and transverse members 28*a* are relatively short. This difference, in turn, affects the potential tipping directions by reorienting them ninety degrees relative to the carriage tracks. In this arrangement auxiliary track 12 faces toward the adjacent carriage track 20 to receive the entire longitudinal outer edge 58 of finger 48, rather than just the free end 54 as discussed above. A spacer 56 may be used to mount retainer flange 14 to carriage member 26*a*, if necessary to adequately space flange 14 beyond the adjacent carriage track 20. Additionally, only one auxiliary track will be needed even when used with long storage units. As can be seen in FIG. 2 any twisting motion can be prevented through the use of a pair of flanges 14 attached to opposite ends of carriage 22*a*. Of course two tracks could be used if desired. The downward inclination of segment 32 also, in this embodiment, provides a secure and stable flat-to-flat contact with anti-tip flange 14. This arrangement reduces large point stresses in the components and increases the frictional resistance between the flange 14 and auxiliary track 12 to further alleviate the chance of slippage. Otherwise, as can be readily appreciated, system 10** includes the same elements and operates in the same manner as discussed above.

The above description is that of a preferred embodiment of the invention. Various alterations and changes can be made without departing from the spirit and broader aspects of the invention as set forth in the appended claims, which are to be interpreted in accordance with the principles of patent law, including the doctrine of equivalents.

I claim:

1. An anti-tip mobile storage system for movably supporting at least one mobile storage unit, said system comprising:

a plurality of carriage tracks supported by a supporting surface;

at least one carriage movably supported on said carriage tracks;

at least one auxiliary track removably secured to the supporting surface and including means for defining an elongated gap, said auxiliary track being independent of said carriage tracks;

first fastening means for removably securing said auxiliary track to the supporting surface;

at least one anti-tip structure removably attached to said carriage and including an extension portion, said extension portion being received within said gap to cooperate with said auxiliary track to prevent said carriage from tipping over; and second fastening means for removably attaching said anti-tip structure to said carriage so that said anti-tip structure can be easily added to a wide variety of mobile storage systems both preexisting and new.

2. An anti-tip mobile storage system as defined in claim 1 wherein said auxiliary track is substantially Z-shaped and includes an anti-tip segment which overlies the supporting surface and defines therewith said gap.

3. An anti-tip mobile storage system as defined in claim 2 wherein said extension portion of said anti-tip structure during normal operation of said carriage is received within said gap such that said extension portion does not engage either of said auxiliary track and the supporting surface.

4. An anti-tip mobile storage system as defined in claim 3 wherein said carriage includes a plurality of longitudinal members which extend substantially parallel to said carriage tracks and a plurality of transverse members which interconnect said longitudinal members, and wherein said anti-tip structure is attached to one of said transverse members.

5. An anti-tip mobile storage system as defined in claim 3 wherein said carriage includes a plurality of longitudinal members which extend substantially parallel to said carriage tracks and a plurality of transverse members which interconnect said longitudinal members, and wherein said anti-tip structure is attached to one of said longitudinal members.

6. An anti-tip mobile storage system as defined in claim 2 wherein said anti-tip segment includes a free end and is inclined downwardly in a direction toward said free end thereof.

7. An anti-tip mobile storage system as defined in claim 1 wherein said extension portion of said anti-tip structure during normal operation of said carriage is received within said gap such that said extension portion does not engage either of said auxiliary track and the supporting surface.

8. An anti-tip mobile storage system as defined in claim 1 wherein said carriage includes a plurality of longitudinal members which extend substantially parallel to said carriage tracks and a plurality of transverse members which interconnect said longitudinal members, and wherein said anti-tip structure is attached to one of said transverse members.

9. An anti-tip mobile storage system as defined in claim 1 wherein said carriage includes a plurality of longitudinal members which extend substantially parallel to said carriage tracks and a plurality of transverse members which interconnect said longitudinal members, and wherein said anti-tip structure is attached to one of said longitudinal members.

10. An anti-tip mobile storage system as defined in claim 1 wherein said carriage includes at least one first member which extends generally parallel to said carriage tracks and at least one second member which extends generally perpendicular to said carriage tracks, and wherein said anti-tip structure has the capacity to cooperate with said auxiliary track to prevent said mobile storage unit from tipping over when attached to either of said first and second members.

11. An anti-tip mobile storage system for movably supporting at least one mobile storage unit, said system comprising:

a plurality of carriage tracks supported on a supporting surface;

carriage means for movably supporting at least one mobile storage unit on said carriage tracks for movement therealong, said carriage means including at least one first member extending generally parallel to said carriage tracks and at least one second member extending generally perpendicular to said carriage tracks;

at least one auxiliary track secured to the supporting surface and defining a elongate structure along the length thereof; and retainer means attached to said carriage means for cooperating with said elongate structure of said auxiliary track for preventing said carriage means and mobile storage unit from tipping over, said retainer means having the capacity to so cooperate with said elongate structure of said auxiliary track to prevent said tipping when attached to said first carriage member and alternatively when attached to said second carriage member.

12. A mobile storage system as defined in claim 11 wherein said elongate structure of said auxiliary track further includes a retaining segment which overlies the supporting surface and therewith defines a gap for receiving said retainer means attached to said carriage means.

13. A mobile storage system as defined in claim 12 in which said retainer means includes at least one substantially L-shaped flange, and wherein said flange includes an extension portion which is received within said gap and cooperates with said auxiliary track to prevent the mobile storage unit from tipping over when said flange is attached alternatively to either of said first and second carriage members.

14. A mobile storage system as defined in claim 12 wherein said retaining segment of said auxiliary track includes a free end and is inclined downwardly in a direction toward said free end thereof.

15. A mobile storage system as defined in claim 11 which further includes a pair of auxiliary tracks, wherein each of said auxiliary tracks are positioned adjacent a different carriage track, and wherein said retainer means attached to either of said first and second carriage members cooperates with said elongate structures defined by each of said auxiliary tracks to prevent the mobile storage unit from tipping over.

16. A mobile storage system as defined in claim 15 in which said retainer means attached to said carriage means includes a plurality of flanges, wherein at least one flange cooperates with each of said auxiliary tracks.

17. An improved anti-tip mobile shelving system including track means for defining a generally linear path, a plurality of shelving assemblies movably supported on said track means for movement along the linear path, and anti-tip means for preventing said shelving assemblies from tipping over, wherein the improvement comprises said anti-tip means comprising:

an elongated retainer track secured to the support surface and positioned substantially parallel to said linear path; and a retainer bracket secured to each of said shelving assemblies and interfitting with said retainer track to permit relative movement therebetween as said shelving assemblies move along said linear path and to prevent relative movement therebetween if said shelving assemblies attempt to tip over, each said retainer bracket including a mounting portion secured to one of said shelving assemblies and a retainer portion projecting outward from said mounting portion in two generally horizontal directions so that said retainer bracket interfits with said retainer track regardless of whether said retainer bracket is secured to a portion of said shelving assembly extending parallel to said linear path or angularly thereto.

18. A kit for an anti-tip mobile storage system comprising:

at least one first mobile storage unit having a longitudinal axis and being shaped such that its longitudinal dimension is greater than its transverse dimension, and further including means for supporting said first mobile storage unit for movement in a direction generally parallel to said longitudinal axis;

at least one second mobile storage unit having a longitudinal axis and being shaped such that its longitudinal dimension is greater than its transverse dimension, and further including means for supporting said second mobile storage unit for movement in a direction generally perpendicular to said longitudinal axis;

a plurality of carriage tracks supported on a supporting surface and positioned substantially parallel with one another to movably support either of said first and second mobile storage units thereon, said carriage tracks being positioned alternatively in either one of two positions, said positions including a first position with said carriage tracks arranged substantially parallel with said longitudinal axis of said first storage unit and a second position with said carriage tracks arranged substantially perpendicular to said longitudinal axis of said second mobile storage unit;

at least one retainer track secured to the supporting surface, said retainer track being positioned substantially parallel to said carriage tracks, irrespective of said position of said carriage tracks; and at least one retainer element having the capacity to be attached to either of said first and second mobile storage units to cooperate with said retainer track to prevent said corresponding mobile storage unit from tipping in a direction perpendicular to its longitudinal axis.

19. A kit as defined in claim 18 wherein said retainer track includes a segment which overlies the supporting surface and defines therewith a gap which receives said retainer element to prevent the tipping of said storage unit.

20. A kit as defined in claim 18 in which said first and second mobile storage units include at least one longitudinal component and at least one transverse component, and in which said retainer element is secured to said longitudinal component of either of said mobile storage units irrespective of which mobile units are movably supported on said carriage tracks.

21. An anti-tip mobile storage system comprising:

a plurality of carriage tracks supported by a supporting surface and positioned generally parallel with one another;

carriage means for providing storage space, said carriage means defining a longitudinal dimension and a transverse dimension, said longitudinal dimension being greater than said transverse dimension, said carriage means being movably supported on said carriage tracks such that said tracks are alternatively arranged in one of two positions including a first position with said tracks arranged generally parallel with said longitudinal dimension and a second position with said tracks arranged generally parallel with said transverse dimension;

at least one retainer track secured to the supporting surface and positioned generally parallel with said carriage tracks, said retainer track having an anti-tip structure extending along its length; and at least one retainer element attached to said carriage means, said retainer element having the capacity to cooperate with said anti-tip structure of said retainer track to prevent said carriage means from tipping over in both said alternative carriage track positions.

22. An anti-tip mobile storage system as defined in claim 21 in which said retainer element includes a mounting portion attached to said carriage and a retainer portion which extends outward from said mounting portion in at least two directions so that said retainer element is capable of cooperating with said retainer tracks in both of said alternative track positions.

23. An anti-tip mobile storage structure as defined in claim 22 in which said mounting and retainer portions of said retainer element are oriented generally at right angles to each other with said retainer portions projecting laterally outward from said mounting portion in a direction generally perpendicular to said longitudinal direction and in a direction generally parallel thereto.

* * * * *